US005314549A

United States Patent [19]

Misao et al.

[11] Patent Number: 5,314,549

[45] Date of Patent: May 24, 1994

[54] HIGH STRENGTH AND HIGH TOUGHNESS STAINLESS STEEL SHEET AND METHOD FOR PRODUCING THEREOF

[75] Inventors: Hitoshi Misao; Katsuhisa Yamauchi; Tadashi Inoue; Tomoyoshi Okita, all of Kawasaki, Japan

[73] Assignee: NKK Corporation, Tokyo, Japan

[21] Appl. No.: 99,171

[22] Filed: Jul. 29, 1993

[30] Foreign Application Priority Data

Mar. 8, 1993 [JP] Japan ..... 5-072901

[51] Int. Cl.[5] ..... C22C 38/40; C21D 8/00

[52] U.S. Cl. ..... 148/325; 148/327; 148/610

[58] Field of Search ..... 148/325, 327, 610

[56] References Cited

U.S. PATENT DOCUMENTS 4,849,166 7/1989 Hoshino et al. .
5,167,731 12/1992 Minami et al. ..... 148/325
5,232,520 8/1993 Oka et al. ..... 148/327

FOREIGN PATENT DOCUMENTS 61-295356 12/1986 Japan .
63-317628 12/1988 Japan .
2-44891 10/1990 Japan .

*Primary Examiner*—Deborah Yee
*Attorney, Agent, or Firm*—Frishauf, Holtz, Goodman & Woodward

[57] ABSTRACT

A stainless steel sheet essentially consisting of: 0.01 to 0.2 wt. % C, 0.1 to 2 wt. % Si, 0.1 to 2 wt. % Mn, 4 to 11 wt. % Ni, 13 to 20 wt. % Cr, 0.01 to 0.2 wt. % N, 0.0005 to 0.0025 wt. % sol.Al, 0.002 to 0.01 wt. % O, 0.009 wt. % or less S, and the balance being Fe and inevitable impurities; the sheet containing 40 to 90% martensite; and the steel sheet having a 1400 N/mm$^2$ or more tensile stress when a tensile strain is 1.0%. The invention also provides a method for producing a stainless steel sheet comprising the steps of: applying to the steel sheet a process of first cold rolling ($CR_1$)—first intermediate annealing—second cold rolling ($CR_2$)—second intermediate annealing—third cold rolling ($CR_3$)—the final annealing—fourth cold rolling ($CR_4$)—low temperature heat treatment; the first-, second- and third cold reduction ratio being 30% to 60%; the annealing temperatures in the first-, second- and final annealing being in the range of 950° C. to 1100° C.; the fourth cold reduction ratio being 66% to 76%; and the low temperature heat treatment ranging 300° C. to 600° C. for a period of 0.1 sec to 300 sec.

14 Claims, 4 Drawing Sheets

HIGH STRENGTH AND HIGH TOUGHNESS STAINLESS STEEL SHEET AND METHOD FOR PRODUCING THEREOF

BACKGROUND OF THE INVENTION

The present invention relates to a high strength and high toughness stainless steel sheet used as a substrate etc. of extremely thin inner diameter saw blades which are used for manufacturing of silicon wafers.

DESCRIPTION OF THE RELATED ARTS

Hitherto, as stainless spring steel for substrate of inner diameter saw blades, metastable austenitic stainless steel and precipitation hardening stainless steel have been applied. However, recently, the unstable qualities and high fracture-probability of these steels have caused problems for users.

Typical examples of the metastable austenitic stainless steels are SUS 301 and SUS 304. Cold working after solid solution treatment developes work-induced martensite in said stainless steel sheet, and high strength steel sheet is obtained. Such type of steel was introduced in JP-B-2-44891. According to this publication, $Md_{30}$ is adjusted to a predetermined value by the selection of contents of C, N, Si, Mn, Ni, Cr and Mo. $Md_{30}$ is specified by the equation below.

$$Md_{30}=551-462(C\%+N\%)-9.25Si\%-8.1Mn\%-29Ni\%-13.7Cr\%-18.5Mo\%$$

By specifying the third cold-reduction ratio ($CR_3$) to be 40% or more and the proportion of the first cold-reduction ratio ($CR_1$) and the second-cold reduction ratio ($CR_2$) to be 0.8 or more, the tensile strength becomes 130 kg/mm$^2$ or more and the plane anisotropy of strength becomes weak. By such countermeasures, the flatness of the inner diameter saw blade, when applied with tension, is improved.

A typical example of the precipitation hardening stainless steel is SUS 631. By cold working or sub-zero treatment of the steel after solution treatment, martensitic structure or two phase structure of austenite and martensite develops. In the successive aging-treatment, the precipitation hardening proceeds. Such types of steel were introduced in JP-A-61-295356 and JP-A-63-317628. By adding of both Si and Cu, the precipitation hardening proceeds and Hv=580 is obtained. Moreover, high cracking strength is achieved and stretch formability is improved. The cracking strength is defined as the quotient of crack-generating stress divided by both plate thickness and punch diameter.

A weak point of the above-mentioned stainless steels as materials of the inner diameter saw blades is their high probability of fracture during usage. This high probability of fracture extremely decreases the productivity of wafer slicing. However, no study has been performed on parameters controlling the fracture characteristic of an inner diameter saw blade in the prior art, and it was not possible to improve the resistance to fracture.

Although, in the JP-B-2-44891, the plane anisotropy has been considered but the fracture characteristic has not been respected at all. In the JP-A-61-295356 and the JP-A-63-317628, properties before the stretch forming have been considered but the fracture during usage as slicers after the stretch forming has not been considered. In fact, the strength of the precipitation hardening stainless steel according to the JP-A-61-295356 and the JP-A-63-317628 are extremely high and the nonmetallic inclusions are large and numerous. Accordingly, the probability of fracture during slicing work is high even in the case of the stainless steel having the good stretch formability. (The terms "JP-B-" and "JP-A-" refered above signify "examined Japanese patent publication" and "unexamined Japanese patent publication", respectively.)

SUMMARY OF THE INVENTION

The object of the present invention is to provide a stainless steel sheet having high resistance to fracture and a method for producing thereof.

To achieve the object, the present invention provides a high strength and high toughness stainless steel sheet consisting essentially of:

0.01 to 0.2 wt. % C, 0.1 to 2 wt. % Si, 0.1 to 2 wt. % Mn, 4 to 11 wt. % Ni, 13 to 20 wt. % Cr, 0.01 to 0.2 wt. % N, 0.0005 to 0.0025 wt. % sol.Al, 0.002 to 0.01 wt. % O, 0.009 wt. % or less S, and the balance being Fe and inevitable impurities;

said inevitable impurities existing as nonmetallic inclusions, said nonmetallic inclusions having a composition situated in a region defined by nine points given below in a phase diagram in a 3-component system of "$Al_2O_3$-MnO-$SiO_2$", Point 1 ($Al_2O_3$: 21%, MnO: 12%, $SiO_2$: 67%),
Point 2 ($Al_2O_3$: 19%, MnO: 21%, $SiO_2$: 60%),
Point 3 ($Al_2O_3$: 15%, MnO: 30%, $SiO_2$: 55%),
Point 4 ($Al_2O_3$: 5%, MnO: 46%, $SiO_2$: 49%),
Point 5 ($Al_2O_3$: 5%, MnO: 68%, $SiO_2$: 27%),
Point 6 ($Al_2O_3$: 20%, MnO: 61%, $SiO_2$: 19%),
Point 7 ($Al_2O_3$: 27.5%, MnO: 50%, $SiO_2$: 22.5%),
Point 8 ($Al_2O_3$: 30%, MnO: 38%, $SiO_2$: 32%),
Point 9 ($Al_2O_3$: 33%, MnO: 27%, $SiO_2$: 40%);

the steel sheet containing 40 to 90% martensite; and the steel sheet having at least 1400 N/mm$^2$ tensile stress when a tensile strain is 1.0%.

Another stainless steel sheet which satisfies the above-mentioned object and also has improved corrosion resistance consists essentially of;

0.01 to 0.2 wt. % C, 0.1 to 2 wt. % Si, 0.1 to 2 wt. % Mn, 4 to 11 wt. % Ni, 0.08 to 0.9 wt. % Cu, 13 to 20 wt. % Cr, 0.01 to 0.2 wt. % N, 0.0005 to 0.0025 wt. % sol.Al, 0.002 to 0.01 wt. % O, 0.009 wt. % or less S, and the balance being Fe and inevitable impurities.

Moreover, the present invention provides a method for producing a high strength and high toughness stainless steel sheet comprising the steps of:

preparing a stainless steel strip consisting essentially of 0.01 to 0.2 wt. % C, 0.1 to 2 wt. % Si, 0.1 to 2 wt. % Mn, 4 to 11 wt. % Ni, 13 to 20 wt. % Cr, 0.01 to 0.2 wt. % N, 0.0005 to 0.0025 wt. % sol.Al, 0.002 to 0.01 wt. % O, 0.009 wt. % or less S, and the balance being Fe and inevitable impurities;

said inevitable impurities existing as nonmetallic inclusions, said nonmetallic inclusions having a compositions situated in the region which is defined by nine points given below in a phase diagram in a 3-component system of "$Al_2O_3$-MnO-$SiO_2$", Point 1 ($Al_2O_3$: 21%, MnO: 12%, $SiO_2$: 67%),
Point 2 ($Al_2O_3$: 19%, MnO: 21%, $SiO_2$: 60%),
Point 3 ($Al_2O_3$: 15%, MnO: 30%, $SiO_2$: 55%),
Point 4 ($Al_2O_3$: 5%, MnO: 46%, $SiO_2$: 49%),
Point 5 ($Al_2O_3$: 5%, MnO: 68%, $SiO_2$: 27%),
Point 6 ($Al_2O_3$: 20%, MnO: 61%, $SiO_2$: 19%),
Point 7 ($Al_2O_3$: 27.5%, MnO: 50%, $SiO_2$: 22.5%), Point 8 ($Al_2O_3$: 30%, MnO: 38%, $SiO_2$: 32%), Point 9 ($Al_2O_3$: 33%, MnO: 27%, $SiO_2$: 40%);

applying to the stainless strip a process of first cold rolling ($CR_1$)—first intermediate annealing—second cold rolling ($CR_2$)—second intermediate annealing—third cold rolling ($CR_3$)—final annealing—fourth cold rolling ($CR_4$)—low temperature heat treatment;

reduction ratios of the first-, second- and third cold rolling, each being 30% to 60%;

annealing temperatures in the first-, second- and final annealing, each being in a range of 950° C. to 1100° C.;

the fourth cold reduction ratio being 66% and 76%; and the low temperature heat treatment ranging from 300° C. to 600° C. for a period of 0.1 sec to 300 sec.

DESCRIPTION OF THE PREFERRED EMBODIMENT

The inventors have found that the following three items are important for producing the stainless steel sheet having high fracture resistance as results of studies on the production of such sheets;

(a) For the case where the stainless steel blade is applied with tension, the 1.0% on-set stress of the sheets are to be higher than a critical level and also their ductility should be maintained.

(b) In order to decrease the probability of fracture, the low melting point, high bendability and thin thickness of nonmetallic inclusions are preferable and also the quantity of such inclusions should be lessened.

(c) In addition, the high 1.0% on-set stress as one condition for acquisition of above-mentioned stainless steels is acquired by using a metastable austenite stainless steel having an appropriate amount of martensite, minimizing the grain size and reducing the effective particle size of martensite.

The present invention is based on the above-mentioned findings.

Figure 1:
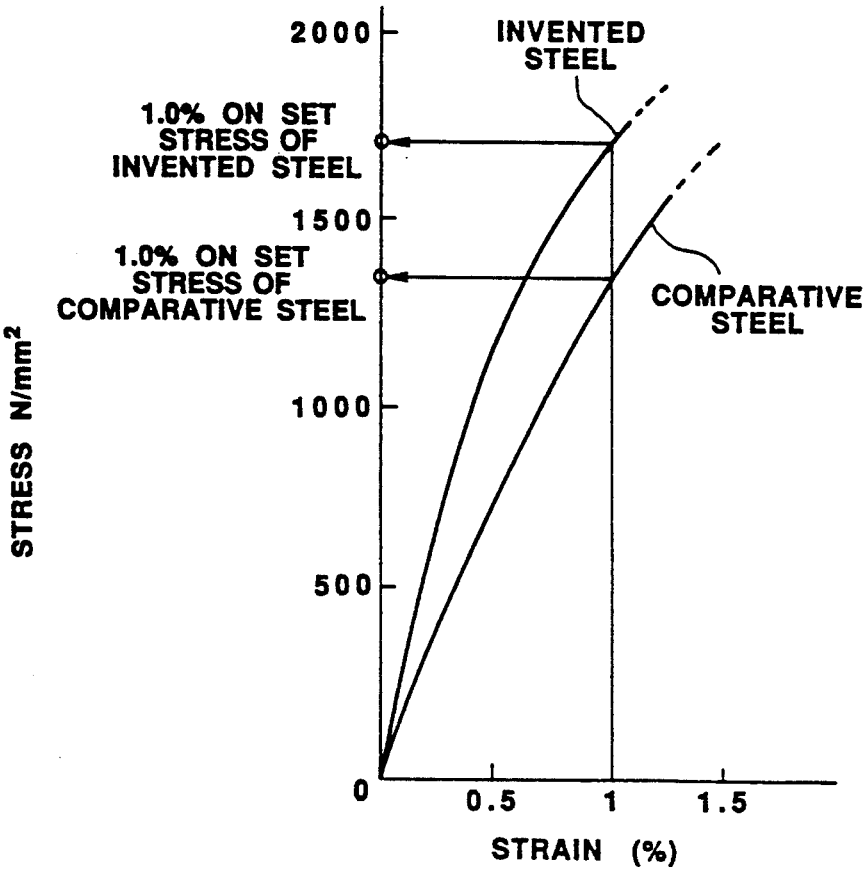
FIG. 1 shows the relation between strain and stress of the present invention.

The steels according to the present invention are specified due to the following reasons. The materials for the inner diameter saw blades must be stainless steel in order to resist the corrosion during cutting of, for example, silicon single crystals. As controlling factors of the fracture resistance of inner diameter saw blades, nonmetallic inclusions and the tensile stress when tensile strain corresponding to 1.0% strain on a tensile curve is applied are important. Hereinafter, the tensile stress when subjected to tensile strain corresponding to 1.0% strain on a tensile curve is reffered as 1.0% on-set stress. FIG. 1 shows the relation between the deformation and the stress, which shows the procedure to determine the 1.0% on-set stress. The 1.0% on-set stress of the steel according to the present invention is higher than that of the comparative steel.

The reason why the 1.0% on-set stress has an effect on the fracture resistance is not clear. The inner diameter saw blades are stretched by about 1.0% tensile strain with tensional bolts for their usage, the stress corresponding to 1.0% strain is considered to be important. If the 1.0% on-set stress is 1400 or more $N/mm^2$ or more, the improvement of fracture resistance is recognized. Consequently, the 1.0% on-set stress of the thin stainless steel sheets for inner diameter saw blades according to the present invention are to be 1400 $N/mm^2$ or more.

In order to improve the fracture resistance of inner diameter saw blades used in the stretched state, such countermeasures as thinning the thickness and decreasing the quantity of inclusions which are liable to become the initiating points of the fracture. As the inner diameter saw blades is extremely thin with the thickness of 0.3 mm or less, the effects of inclusions becomes remarkable. To control this impurities, the improvement of their ductility by decreasing their melting points is effective. Concretely, it is necessary that the compositions of the inevitable nonmetallic inclusions in the stainless steels are included in the range enclosed with lines connecting the following nine points in the phase diagram in a 3-component system of "$Al_2O_3$-MnO-$SiO_2$" in FIG. 3, Point 1 ($Al_2O_3$: 21%, MnO: 12%, $SiO_2$: 67%), Point 2 ($Al_2O_3$: 19%, MnO: 21%, $SiO_2$: 60%), Point 3 ($Al_2O_3$: 15%, MnO: 30%, $SiO_2$: 55%), Point 4 ($Al_2O_3$: 5%, MnO: 46%, $SiO_2$: 49%), Point 5 ($Al_2O_3$: 5%, MnO: 68%, $SiO_2$: 27%), Point 6 ($Al_2O_3$: 20%, MnO: 61%, $SiO_2$: 19%), Point 7 ($Al_2O_3$: 27.5%, MnO: 50%, $SiO_2$: 22.5%), Point 8 ($Al_2O_3$: 30%, MnO: 38%, $SiO_2$: 32%), Point 9 ($Al_2O_3$: 33%, MnO: 27%, $SiO_2$: 40%).

Figure 5:
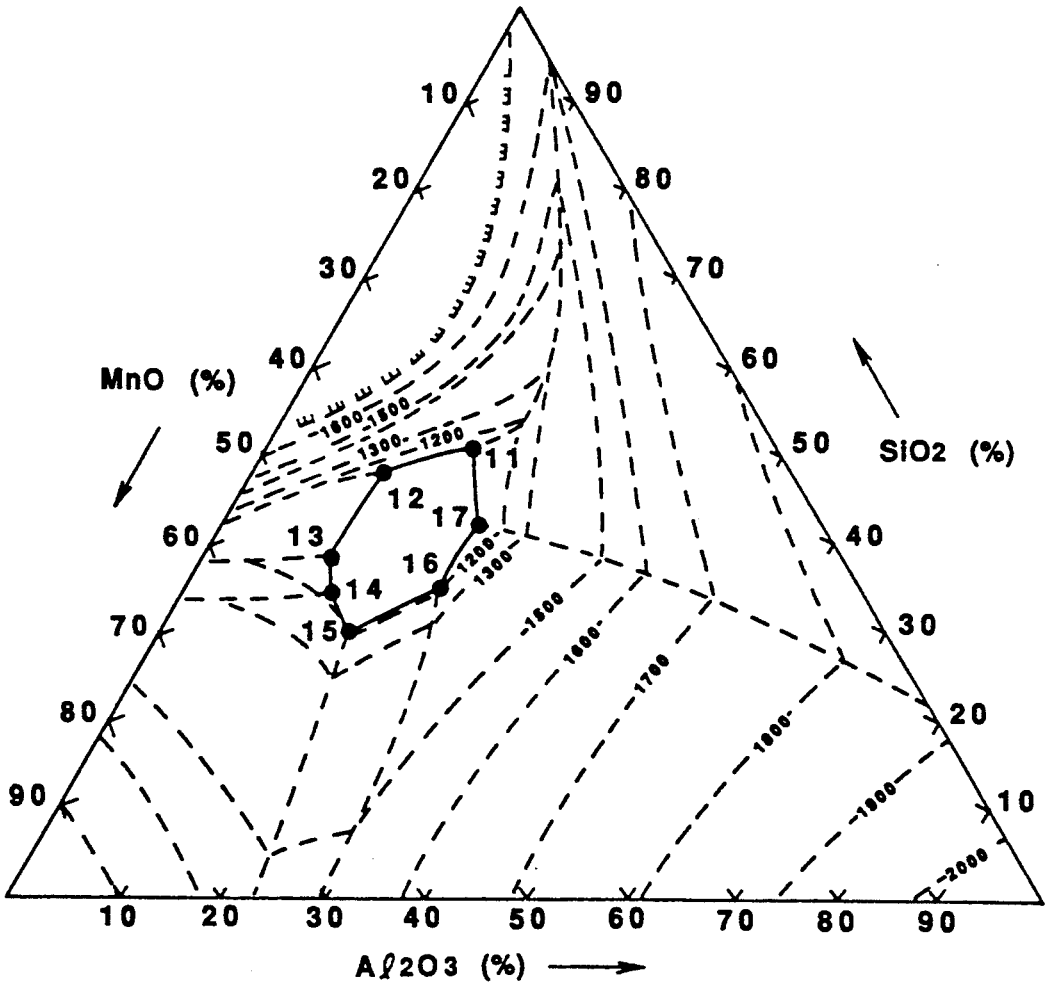
FIG. 5 shows a region of inclusion composition of the present invention in the phase diagram in the 3-component system of "$Al_2O_3$-MnO-$SiO_2$."

The more preferable compositions of the inevitable nonmetallic inclusion are included in the range enclosed with lined connecting the following seven points in the phase diagram in a 3-component system of "$Al_2O_3$-MnO-$SiO_2$" in FIG. 5.

Point 11 ($Al_2O_3$: 20%, MnO: 29.5%, $SiO_2$: 50.5%),

Point 12 ($Al_2O_3$: 12.5%, MnO: 39%, $SiO_2$: 48.5%),

Point 13 ($Al_2O_3$: 12%, MnO: 50%, $SiO_2$: 38%),

Point 14 ($Al_2O_3$: 14%, MnO: 52%, $SiO_2$: 34%),

Point 15 ($Al_2O_3$: 18%, MnO: 52%, $SiO_2$: 30%),

Point 16 ($Al_2O_3$: 24%, MnO: 41%, $SiO_2$: 35%),

Point 17 ($Al_2O_3$: 24.5%, MnO: 33.5%, $SiO_2$: 42%).

The chemical composition is defined as follows;

C is an austenite-forming element. 0.01 wt. % or more C is necessary for suppression of δ-ferrite and strengthening of work-induced martensite. However, when the content of C exceeds 0.2 wt. %, much quantities of chromium-carbides precipitate and cause decrease of corrosion resistance and elongation. Consequently, the range of C content is specified to 0.01–0.2 wt. %.

0.1 wt. % or more Si is necessary for solid-solution strengthening of austenite and work-induced martensite. However, when the content of Si exceeds 2 wt. %, δ-ferrite precipitates and causes decrease of hot workability. Consequently, the range of Si content is specified to 0.1–2 wt. %.

Mn is an austenite-forming element. 0.1 wt. % or more Mn is necessary for obtaining single-phase austenite after solid-solution treatment and for deoxidation. However, when the content of Mn exceeds 2 wt. %, the generation of work-induced martensite is suppressed too much. Consequently, the range of Mn content is specified to 0.1–2 wt. %.

Ni is an austenite-forming element. When the content of Ni is less than 4 wt. %, single-phase austenite dows not develop after annealing. On the other hand, when the content of Ni is more than 11 wt. %, austenite becomes too stable and enough quantity of work-induced martensite do not generate. Consequently, the range of Ni content is specified to 4–11 wt. %.

13 wt. % or more Cr is necessary for corrosion resistance as stainless steel. However, when the content of Cr exceeds 20 wt. %, the quantity of ferrite increases and hot workability decreases. Consequently, the range of Cr content is specified to 13–20 wt. %.

Cu is preferable for stabilizing a passive surface layer and for improvement of corrosion resistance as a material of an inner diameter saw blade. 0.08 wt. % or more Cu is necessary for improvement of corrosion resistance. However, when the content of Cu exceeds 0.9 wt. %, the effect on improvement of corrosion resistance saturates and hot workability decreases. Consequently, the range of Cu content is specified to 0.08–0.9 wt. %.

0.01 wt. % or more N is necessary for formation of austenite and for solid-solution hardening of martensite. However, the content of N more than 0.2 wt. %, causes blowhole in a casting. Consequently, the range of N content is specified to 0.01–0.2 wt. %.

S forms MnS as an inclusion. This MnS easily causes initiation of fracture. When the content of S exceeds 0.009 wt. %, the probability of fracture increases. Consequently, the upper limit of the content of S is specified to 0.009 wt. %. By reducing the content of S, the decrease of fracture probability of a material having high 1.0% on-set stress is possible.

P segregates in the grain boundaries, and hot workability and corrosion resistance deteriorates when P is added too much. 0.03 wt. % or less P is desirable.

Figure 3:
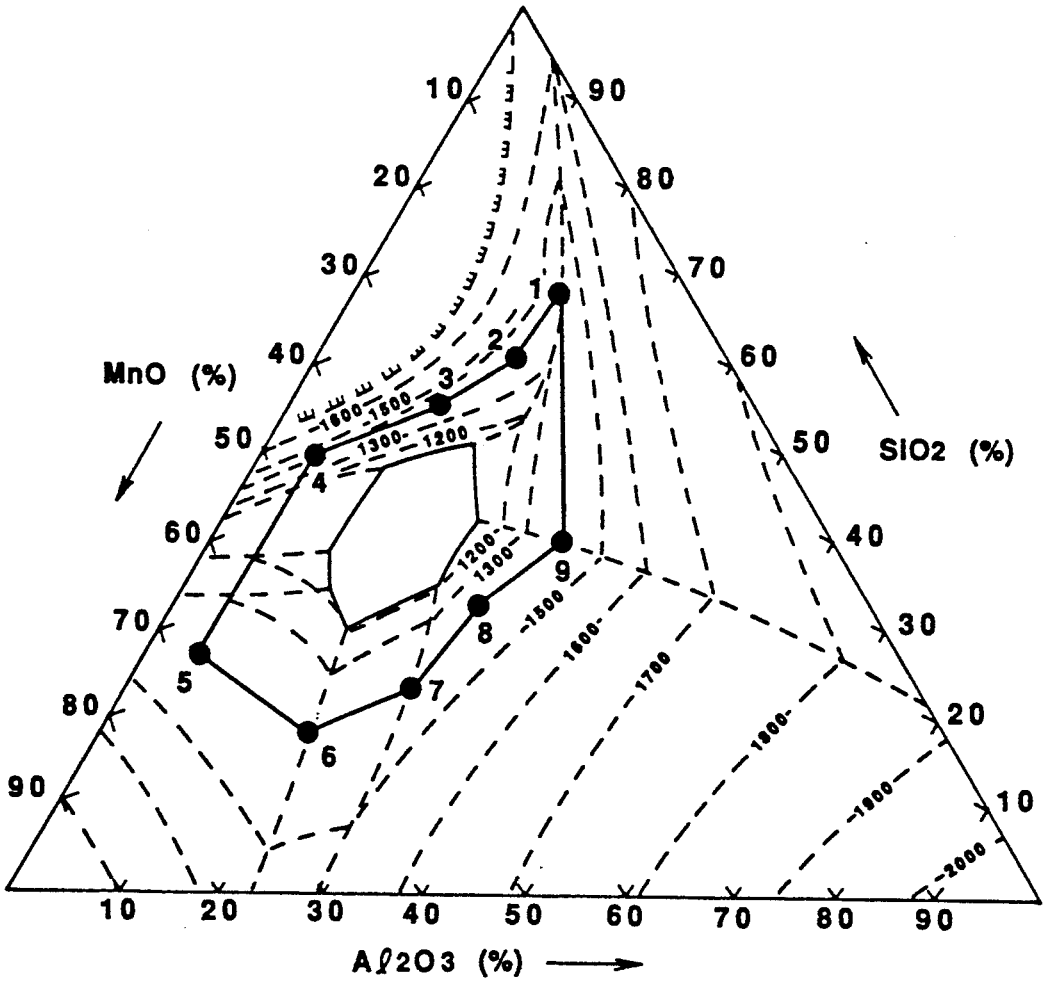
FIG. 3 shows a region of inclusion composition of the present invention in the phase diagram in a 3-component system of "$Al_2O_3$-MnO-$SiO_2$"

Sol. Al determines quantity and composition of nonmetallic inclusions. When sol. Al exceeds 0.0025 wt. %, the content of O in the molten steel becomes less than 0.002 wt. % and the quantity of inclusions decreases. But, in this case, the composition of inclusion is that of $Al_2O_3$-type inclusion and a surface defect appears. Fracture easily initiates at the defect and the probability of fracture increases. When sol. Al is less than 0.0005 wt. %, the content of O in the molten steel becomes more than 0.01 wt. % and the quantity of inclusions increases. Moreover, in this case, the composition of inclusion is that of $MnO$-$SiO_2$-binary type inclusion or that of $Cr_2O_3$. The hot ductility of these inclusions are low due to their high melting point. Fracture easily initiates also at these inclusions and the probability of fracture increases. Accordingly, in order for an inclusion not to initiate fracture, the composition of the inclusion is specified to be an $Al_2O_3$-$MnO$-$SiO_2$-type inclusion as shown in FIG. 3. This inclusion has a low melting point and a high hot ductility. Moreover, the thickness of the inclusion is made as thin as possible. Consequently, the range of sol. Al is specified to 0.0005–0.0025 wt. % and the range of O content is specified to 0.002–0.01 wt. %. In order to get such composition of an inclusion, in a ladle refining after teeming, a ladle lined with MgO-CaO-type refractories in which the content of CaO is 50% or less is used. Concerning to the composition of a slag in the ladle refining, such conditions as follows are preferable:

$[CaO]/[SiO_2]$: 1.0–4.0, $Al_2O_3$: 3 wt. % or less,

MgO: 15 wt. % or less,

CaO: 30–80 wt. %.

In the steels according to the present invention, the balance of those elements above-mentioned consists essentially of Fe, but such elements as Ca, rare-earth metals, B for control of configulation of sulfide and improvement of hot workability and other inevitable impurities may be contained in the steels.

Figure 2:
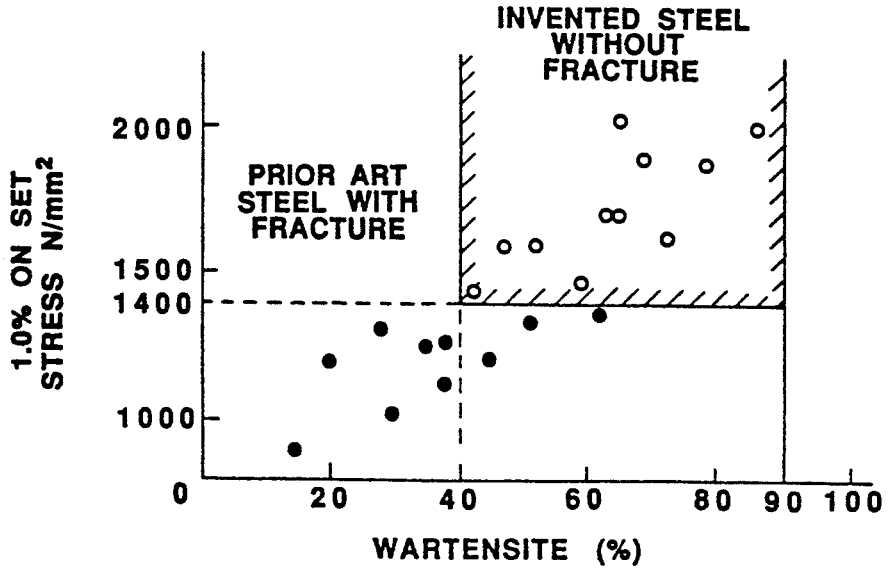
FIG. 2 shows the effects of both 1.0% on-set stress and martensite content on the fracture characteristic.

On the other hand, the inventors have in detail investigated factors which increase the 1.0% on-set stress. As the result, it has been found that in order to obtain a high 1.0% on-set stress, an optimum quantity of martensite, and as below-mentioned, an optimum effective diameter of martensite grain and an optimum condition of aging treatment are necessary. FIG. 2 shows the effects of 1.0% on-set stress and quantity of martensite on fracture characteristics. When the amount of martensite exceeds 90%, the measurement of 1.0% on-set stress was impossible because of an eary fracture. As shown in FIG. 2, in order to avoid fractures of steel sheet which has 1400 N/mm$^2$ or more 1.0 on-set stress, 40% or more martensite, besides such factors as an optimum effective diameter of martensite grain and an optimum condition of aging treatment, is necessary. However, when the quantity of martensite exceeds 90%, ductility decreases and fracture occurs during stretching. Consequently, the range of quantity of martensite is specified to 40 to 90%. Moreover, it is worthy to note that in FIG. 2, even though the quantity of martensite is in the range 40 to 90%, fractures occur in sheets having 1.0% on-set stress less than 1400 N/mm$^2$. 55% to 65% martensite is more preferable because good punch work load of 1068 N/mm$^2$ or more is obtained and 1.0% on-set stress of 1400/mm$^2$ ore more is maintained.

The following is the description of the manufacturing method of the above-mentioned thin stainless steel sheet having high 1.0% on-set stress and high fracture resistance for inner diameter saw blades.

The stainless strip having the above mentioned chemical composition receives processes as follows:

Annealing and pickling—first cold rolling ($CR_1$)—first intermediate annealing—second cold rolling ($CR_2$)—second intermediate annealing—third cold rolling ($CR_3$)—final annealing—fourth cold rolling ($CR_4$)—low temperature heat treatment.

The first-, second- and third cold reduction ratios, each are between 30% and 60%.

The annealing temperature in the first intermediate, second intermediate and final annealing is in the range of 950° C. to 1100° C.

The forth cold reduction ratio is 66% to 76%.

The low temperature annealing is performed at the temperature range of 300° C. to 600° C. for a period of 0.1 sec to 300 sec. As the results, the 1.0% on-set stress becomes 1400 N/mm$^2$ or more and the content of martensite becomes 40 to 90%.

In the above-mentioned processes as "annealing and pickling—first cold rolling ($CR_1$)—first intermediate annealing—second cold rolling ($CR_2$)—second intermediate annealing—third cold rolling ($CR_3$)—the final annealing", by repetition of both the cold rolling and annealing in the temperature range of 950° to 1000° C., very fine recrystalized structure is obtained and also, by precipitation of fine carbides in each annealing, the effective diameter of martensite grain after finish-rolling becomes small. The more the number of repetition of the cold-rolling and annealing is, the better. But, as too many repetitions make the manufacturing method too complicated, the number of repetition is specified to 3.

It is preferable that the first-, second- and third cold reduction ratios are 30% to 60%.

When the cold reduction ratio is less than 30%, the grain structure after annealing becomes mixed and the quality of steel is likely not to become uniform. However, by the cold reduction ratio more than 60%, does not make the grain finer no more and a rolling load increases. By the processes from the first cold-rolling ($CR_1$) to the third cold-rolling ($CR_3$), a high strength and an enough ductility are obtained and also a fracture resistance increases.

Figure 4:
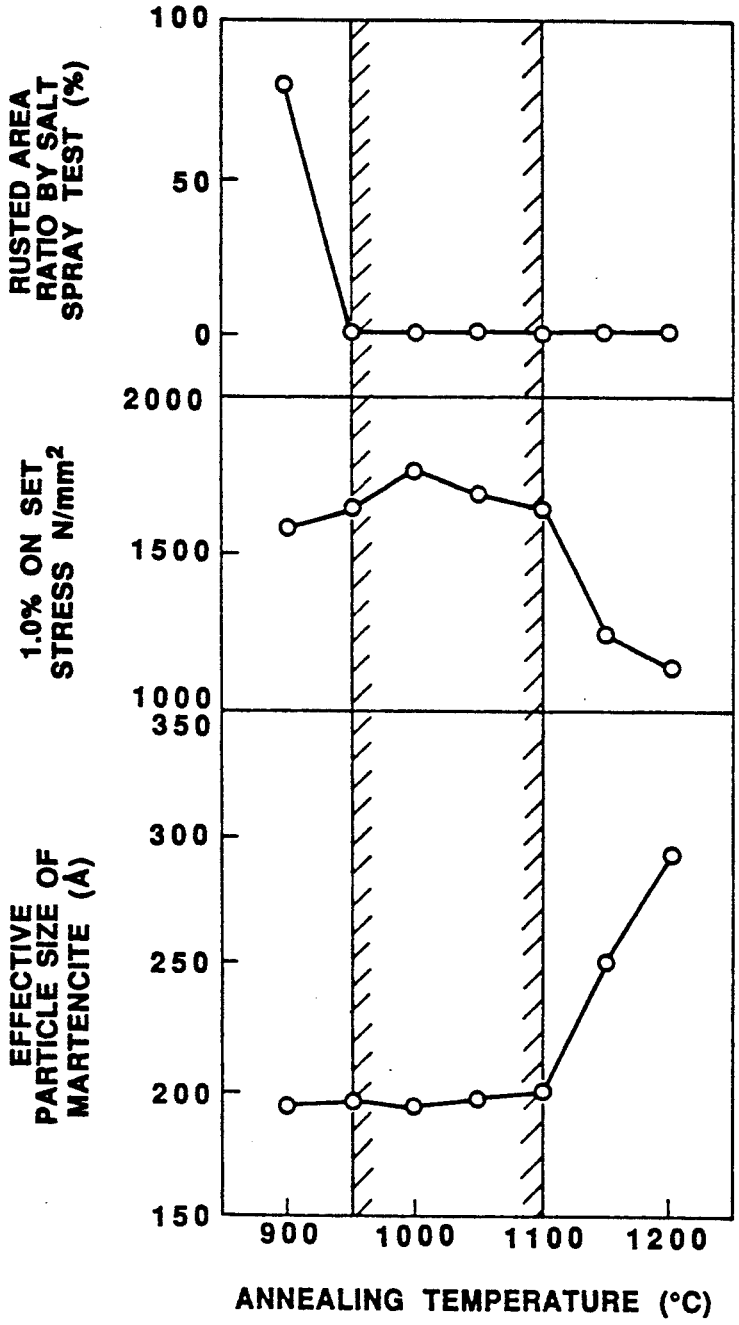
FIG. 4 shows the effects of the annealing temperature on the effective grain size of martensite, the 1.0% on-set stress and the corrosion resistance according to this invention.

FIG. 4 shows the effects of the annealing temperature on the effective grain diameter of martensite, the 1.0% on-set stress and the corrosion resistance. When the annealing temperature is lower than 950° C., the effective grain diameter of martensite is small and the 1.0% on-set stress is 1400 N/mm$^2$ or more. But, due to many precipitated carbides, rusting occurs. When the annealing temperature is higher than 1100° C., a corrosion resistance is improved due to a solid-solution of carbides but, the effective grain diameter of martensite becomes large and the 1.0% on-set stress decreases. By the annealing in the temperature range of 950° to 1100° C., the fine effective grain diameter of martensite and the high 1.0% on-set stress are obtained. Moreover, in the case of such range of annealing temperature, the precipitated carbides are very fine and the rusting does not occur. More preferable temperature range is 1025° to 1075° C.

The fourth cold reduction ratio as a finish-rolling is 66% to 76%. With this cold reduction ratio, the content of martensite becomes 40 to 90% and the 1.0% on-set stress increases. When the reduction ratio is less than 66%, the content of martensite becomes less than 40%. When the reduction ratio is more than 76%, the content of martensite becomes more than 90% and a ductility decreases. By the low temperature heat treatment in the temperature range of 300° C. to 600° C. for a period of 0.1 sec to 300 sec which is operated after the finish cold-rolling, the strength and the 1.0% on-set stress increase and the fracture resistance is further improved. When the temperature is lower than 300° C., the 1.0% on-set stress is less than 1400 N/mm$^2$ due to a incomplete aging. When the temperature is higher than 600° C., the 1.0% on-set stress decreases due to a generation of an inversely transformed austenite. When the soaking time is less than 0.1 sec, the 1.0% on-set stress becomes less than 1400 N/mm$^2$. However, by the soaking time more than 300 sec, the quality improving effect saturates and by the soaking at the temperature near 600° C., the 1.0% on-set stress, on the contrary, decreases due to the generation of inversely transformed austenite. Consequently, the range of soaking time of 0.1 to 300 sec is preferable. The most preferable conditions of the low temperature heat treatment are in the range of 400° to 500° C. and 2 to 8 sec.

By the manufacturing according to the above-mentioned conditions, the production of stainless steel sheet for inner diameter saw blades having stable quality and the extremely low fracture probability is possible.

The stainless steel for inner diameter saw blades according to the present invention are not limited only to metastable austenitic stainless steel but martensite-type-, austenite-type- and semi-austenite-type precipitation hardening stainless steels are also included in the present invention. Moreover, the stainless steels for inner diameter saw blades according to the present invention may use such raw materials as a directly cast thin plate, a cast- or a hot-worked thin steel strip.

EXAMPLE

Twenty types of steel as shown in Table 1 were smelted. A–J are steels according to the present invention and K–T are steels for comparison. By hot-rolling, annealing and pickling, steel sheets with thickness 2.5 mm were manufactured. These sheets were treated according to the manufacturing conditions shown in Table 2 and 3. As a result, materials No. 1–27 were obtained. Materials No. 1–16 are made from the steels satisfying the specifications according to the present invention and materials No. 17–27 are made from the comparative steels. For example, in material No. 1, steel A of table 1 was used and the following processing were performed:

first cold rolling of reduction ratio of 36%,
first intermediate annealing of 1000° C. and 30 sec,
second cold rolling of reduction ratio of 38%,
second intermediate annealing of 1000° C. 30 sec,
third cold rolling of reduction ratio 55%,
final annealing of 1025° C. and 40 sec,
fourth cold rolling of reduction ratio of 67% till 0.15 mm in thickness, and
low temperature heat treatment of 300° C. and 300 sec.

Steels other than No. 17, 18, 25 and 26 were manufactured under such conditions as follows:

the ladle lining: MgO—CaO type refractories in which the content of CaO is 50% or less;

the composition of slag which is $CaO—SiO_2—Al_2O_3$ type: $[CaO]/[SiO_2]$ is 1.0 to 4.0, the content of $Al_2O_3$ is 3 wt. % or less, the content of MgO is 15 wt. % or less and the content of CaO is 30 to 80 wt. %.

Table 4 shows mechanical characteristics of the products. An effective grain diameter of martensite was determined by a X ray diffraction method and two Hall's formulas as follows:

$$[(\beta\cos\theta)/\lambda]^2=(1/a^2)+(\epsilon^2\sin\theta)/\lambda^2$$

$$\beta^2=B^2-b^2$$

Here, a: effective grain diameter, $\beta$: half breadth of X ray diffraction peak, $\lambda$: wave length of x ray, $\epsilon$: effective distortion, $\theta$: Bragg angle, B: integral breadth of X ray diffraction peak, b: constant of diffraction apparatus.

For the measurement, the peak breadth of diffraction from the plane (211) and (422) of martensite was used. Moreover, the thickness of the effective grain diameter of martensite in the direction of steel sheet thickness was measured to determine the number of inclusions per 10 mm$^2$ by size. The fracture probability is determined, while the stretching characteristics was evaluated by the workload necessary for fracture in a small size punch test. Also, the area of rusting surface was measured after spraying 10% NaCl-solution at a temperature of 50° C. for 2160 hours.

In Table 4, A type inclusions are inclusions viscously deformed, B type inclusions are grains that lined discontinuously in a group in a working direction and C type inclusions are inclusions that deserse irregulary without viscous deformation.

As shown in FIG. 4, the 1.0% on-set stress, the fracture workload in the small size punch stretchability test of the materials No. 1–15 made from the invented steels are higher than that of the compared steels and the fracture in usage did not occur. Corrosion resistance of the former is also good because of small amount of Cu. As for No. 16, the mechanical properties are good, but the corrosion resistance is not so good. As for No. 17 and 18, fractures occurred in both the small size punch stretchability test and the fracture performance test. The fracture was intitiated at the inclusion.

As shown in Table 1, the inclusion in the steels of the present invention which satisfy of the specifications of the invention concerning to the content of sol.Al and O are the $Al_2O_3$-$SiO_2$ type inclusions with melting point 1400° C. or less and elongated in a rolling direction. As for the thickness, it was very thin and that of the A- and B type inclusions was less than 3 μm and that of the C type inclusions was less than 5 μm.

The spheroidal inclusions of materials No. 17 and 18 which did not satisfy the specifications of the present invention concerning to the content of sol.Al and O contained much quantities of $Al_2O_3$.

As for No. 19, the fracture probability was high and the corrosion resistance was low due to the high S-content and numerous sulfide type inclusions.

As for No. 20 which was cold-rolled 3 times, the fracture resistance is lower than that of the invented steels due to its insufficient refinement of a grain and an effective grain of martensite.

As for No. 21, the fracture probability is low due to the low 1.0% on-set stress caused by insufficient quantity of martensite.

As for No. 22, the ductility is insufficient due to too much quantity of martensite caused by the high cold finish reduction ratio. As the resut, the fracture probability increases according to the low work load during stretching.

As for No. 23, the 1.0% on-set stress is low and less than 1400 N/mm$^2$ due to the insufficient aging because the temperature of low temperature annealing was too low. As the result, a fracture sometimes may occur.

As for No. 24 and 27, the fracture probability is high due to the very low 1.0% on-set stress caused by a generation of inversely transformed austenite because the temperature of low temperature heat treatment was too high.

As for No. 25 and 26, fractures initiating at inclusions were recognized in the fracture performance test.

As described in detail above, this invention provides a high strength steel sheet having a low fracture probability and a stable quality. The said stainless steel is to be used as the base plates of inner diameter saw blades, stainless springs and so on.

TABLE 1

| steel | C | Si | Mn | P | S | Cr | Ni | N | sol.Al | O | Cu | Composition of inclusion $SiO_2$ | MnO | $Al_2O_3$ |
|---|---|---|---|---|---|---|---|---|---|---|---|---|---|---|
| | | | | | | Steel of the present invention | | | | | | | | |
| A | 0.969 | 0.65 | 1.01 | 0.027 | 0.0002 | 16.8 | 6.83 | 0.027 | 0.0007 | 0.0058 | 0.23 | 42 | 45 | 13 |
| B | 0.032 | 1.95 | 0.30 | 0.031 | 0.0021 | 15.9 | 5.04 | 0.188 | 0.0011 | 0.0032 | 0.31 | 37 | 46 | 17 |
| C | 0.178 | 0.21 | 0.78 | 0.023 | 0.0015 | 16.1 | 5.02 | 0.103 | 0.0008 | 0.0045 | 0.28 | 40 | 45 | 15 |
| D | 0.119 | 0.89 | 0.21 | 0.024 | 0.0010 | 18.3 | 5.01 | 0.052 | 0.0007 | 0.0033 | 0.25 | 48 | 38 | 15 |
| E | 0.117 | 0.43 | 0.21 | 0.023 | 0.0012 | 13.4 | 9.04 | 0.011 | 0.0008 | 0.0035 | 0.24 | 40 | 47 | 13 |
| F | 0.130 | 1.85 | 0.19 | 0.022 | 0.0006 | 15.5 | 5.89 | 0.011 | 0.0009 | 0.0038 | 0.26 | 35 | 50 | 15 |
| G | 0.110 | 0.60 | 1.85 | 0.036 | 0.0007 | 17.2 | 6.22 | 0.054 | 0.0021 | 0.0038 | 0.18 | 41 | 36 | 23 |
| H | 0.098 | 0.48 | 0.85 | 0.029 | 0.0037 | 16.9 | 6.52 | 0.028 | 0.0008 | 0.0088 | 0.19 | 45 | 35 | 20 |
| I | 0.102 | 0.61 | 0.79 | 0.028 | 0.0048 | 16.8 | 6.78 | 0.031 | 0.0009 | 0.0076 | 0.12 | 46 | 34 | 20 |
| J | 0.099 | 0.22 | 0.98 | 0.003 | 0.0009 | 16.8 | 6.45 | 0.025 | 0.0016 | 0.0022 | 0.02 | 25 | 49 | 26 |
| | | | | | | Comparative steel | | | | | | | | |
| K | 0.098 | 0.66 | 0.96 | 0.030 | 0.0047 | 16.5 | 6.83 | 0.054 | 0.0031 | 0.0018 | 0.22 | 35 | 10 | 55 |
| L | 0.120 | 0.55 | 0.21 | 0.023 | 0.0046 | 16.7 | 6.10 | 0.041 | 0.0004 | 0.0112 | 0.26 | 53 | 45 | 2 |
| M | 0.114 | 0.32 | 0.94 | 0.032 | 0.0096 | 17.3 | 7.20 | 0.082 | 0.0011 | 0.0074 | 0.33 | 21 | 59 | 20 |
| N | 0.099 | 0.48 | 0.95 | 0.029 | 0.0045 | 17.3 | 7.38 | 0.028 | 0.0012 | 0.0076 | 0.32 | 52 | 32 | 16 |
| O | 0.103 | 0.46 | 0.92 | 0.026 | 0.0047 | 16.7 | 6.54 | 0.035 | 0.0009 | 0.0077 | 0.23 | 39 | 53 | 8 |
| P | 0.076 | 0.46 | 0.78 | 0.032 | 0.0048 | 16.8 | 6.79 | 0.012 | 0.0013 | 0.0072 | 0.32 | 39 | 32 | 29 |
| Q | 0.098 | 0.64 | 1.02 | 0.024 | 0.0048 | 16.8 | 6.82 | 0.027 | 0.0008 | 0.0072 | 0.28 | 61 | 18 | 21 |
| R | 0.098 | 0.64 | 1.02 | 0.024 | 0.0046 | 16.8 | 6.82 | 0.027 | 0.0008 | 0.0072 | 0.28 | 28 | 65 | 7 |
| S | 0.077 | 2.71 | 0.21 | 0.021 | 0.0049 | 14.8 | 5.76 | 0.073 | 0.0009 | 0.0076 | 1.88 | 82 | 9 | 9 |
| T | 0.067 | 2.93 | 0.34 | 0.023 | 0.0047 | 14.9 | 5.82 | 0.066 | 0.0008 | 0.0075 | 1.99 | 76 | 17 | 7 |

TABLE 2

| Material No. | Steel | CR1 | CR2 | CR3 |
|---|---|---|---|---|
| | | | Steel of the present invention | |
| 1 | A | 36% CR → 1000° C. × 30 sec → | 38% CR → 1000° C. × 30 sec → | 55% CR → 1025° C. × 40 sec → |
| 2 | A | 55% CR → 1000° C. × 30 sec → | 32% CR → 1000° C. × 30 sec → | 41% CR → 1025° C. × 40 sec → |
| 3 | A | 48% CR → 1000° C. × 30 sec → | 38% CR → 1000° C. × 30 sec → | 38% CR → 1025° C. × 40 sec → |
| 4 | A | 48% CR → 1000° C. × 30 sec → | 38% CR → 1000° C. × 30 sec → | 38% CR → 1025° C. × 40 sec → |
| 5 | A | 36% CR → 1000° C. × 30 sec → | 38% CR → 1000° C. × 30 sec → | 40% CR → 1025° C. × 40 sec → |
| 6 | A | 32% CR → 1000° C. × 30 sec → | 35% CR → 1000° C. × 30 sec → | 55% CR → 1025° C. × 40 sec → |
| 7 | A | 32% CR → 1000° C. × 30 sec → | 35% CR → 1000° C. × 30 sec → | 55% CR → 1025° C. × 40 sec → |
| 8 | B | 36% CR → 960° C. × 30 sec → | 38% CR → 960° C. × 30 sec → | 40% CR → 960° C. × 30 sec → |
| 9 | C | 36% CR → 1080° C. × 15 sec → | 38% CR → 1080° C. × 15 sec → | 55% CR → 1080° C. × 15 sec → |
| 10 | D | 48% CR → 1000° C. × 45 sec → | 38% CR → 1000° C. × 45 sec → | 38% CR → 1000° C. × 45 sec → |
| 11 | E | 48% CR → 1000° C. × 45 sec → | 38% CR → 1000° C. × 45 sec → | 38% CR → 1000° C. × 45 sec → |
| 12 | F | 32% CR → 1040° C. × 15 sec → | 55% CR → 1040° C. × 15 sec → | 41% CR → 1040° C. × 15 sec → |
| 13 | G | 48% CR → 1000° C. × 30 sec → | 38% CR → 1000° C. × 30 sec → | 38% CR → 1025° C. × 40 sec → |
| 14 | H | 48% CR → 1000° C. × 30 sec → | 38% CR → 1000° C. × 30 sec → | 38% CR → 1025° C. × 40 sec → |
| 15 | I | 48% CR → 1000° C. × 30 sec → | 38% CR → 1000° C. × 30 sec → | 38% CR → 1025° C. × 40 sec → |

TABLE 2-continued

| | | | | |
|---|---|---|---|---|
| 16 | J | 48% CR → 1000° C. × 30 sec → | 38% CR → 1000° C. × 30 sec → | 38% CR → 1025° C. × 40 sec → |

| Material No. | Steel | CR4 |
|---|---|---|
| | | Steel of the present invention |
| 1 | A | 67% $CR^{0.15t}$ → 300° C. × 300 sec anneal |
| 2 | A | 67% $CR^{0.15t}$ → 400° C. × 2 sec anneal |
| 3 | A | 70% $CR^{0.15t}$ → 600° C. × 1 sec anneal |
| 4 | A | 70% $CR^{0.15t}$ → 400° C. × 2 sec anneal |
| 5 | A | 75% $CR^{0.15t}$ → 400° C. × 2 sec anneal |
| 6 | A | 70% $CR^{0.15t}$ → 400° C. × 300 sec anneal |
| 7 | A | 70% $CR^{0.15t}$ → 400° C. × 2 sec anneal |
| 8 | B | 75% $CR^{0.15t}$ → 450° C. × 5 sec anneal |
| 9 | C | 67% $CR^{0.15t}$ → 400° C. × 5 sec anneal |
| 10 | D | 70% $CR^{0.15t}$ → 400° C. × 2 sec anneal |
| 11 | E | 70% $CR^{0.15t}$ → 400° C. × 2 sec anneal |
| 12 | F | 67% $CR^{0.15t}$ → 450° C. × 5 sec anneal |
| 13 | G | 70% $CR^{0.15t}$ → 400° C. × 2 sec anneal |
| 14 | H | 70% $CR^{0.15t}$ → 400° C. × 2 sec anneal |
| 15 | I | 70% $CR^{0.15t}$ → 400° C. × 2 sec anneal |
| 16 | J | 70% $CR^{0.15t}$ → 400° C. × 2 sec anneal |

TABLE 3

| Material No. | Steel | CR1 | CR2 | CR3 |
|---|---|---|---|---|
| | | | Steel of the present invention | |
| 17 | K | 48% CR → 1000° C. × 30 sec → | 38% CR → 1000° C. × 30 sec → | 38% CR → 1025° C. × 40 sec → |
| 18 | L | 36% CR → 1000° C. × 30 sec → | 38% CR → 1000° C. × 30 sec → | 46% CR → 1025° C. × 40 sec → |
| 19 | M | 48% CR → 1000° C. × 30 sec → | 38% CR → 1000° C. × 30 sec → | 38% CR → 1025° C. × 40 sec → |
| 20 | N | 60% CR → 1000° C. × 30 sec → | 50% CR → 1025° C. × 40 sec → | |
| 21 | O | 40% CR → 1000° C. × 30 sec → | 50% CR → 1000° C. × 30 sec → | 60% CR → 1025° C. × 40 sec → |
| 22 | P | 31% CR → 1000° C. × 30 sec → | 33% CR → 1000° C. × 30 sec → | 38% CR → 1025° C. × 40 sec → |
| 23 | Q | 48% CR → 1000° C. × 30 sec → | 38% CR → 1000° C. × 30 sec → | 38% CR → 1025° C. × 40 sec → |
| 24 | R | 48% CR → 1000° C. × 30 sec → | 38% CR → 1000° C. × 30 sec → | 38% CR → 1025° C. × 40 sec → |
| 25 | S | 48% CR → 1050° C. × 30 sec → | 38% CR → 1050° C. × 30 sec → | 38% CR → 1080° C. × 30 sec → |
| 26 | T | 48% CR → 1050° C. × 30 sec → | 38% CR → 1050° C. × 30 sec → | 38% CR → 1080° C. × 30 sec → |
| 27 | P | 36% CR → 1000° C. × 30 sec → | 38% CR → 1000° C. × 30 sec → | 46% CR → 1025° C. × 40 sec → |

| Material No. | Steel | CR4 |
|---|---|---|
| | | Steel of the present invention |
| 17 | K | 70% $CR^{0.15t}$ → 400° C. × 30 sec anneal |
| 18 | L | 72% $CR^{0.15t}$ → 400° C. × 30 sec anneal |
| 19 | M | 70% $CR^{0.15t}$ → 400° C. × 30 sec anneal |
| 20 | N | 70% $CR^{0.15t}$ → 400° C. × 30 sec anneal |
| 21 | O | 50% $CR^{0.15t}$ → 400° C. × 30 sec anneal |
| 22 | P | 85% $CR^{0.15t}$ → 400° C. × 30 sec anneal |
| 23 | Q | 70% $CR^{0.15t}$ → 250° C. × 300 sec anneal |
| 24 | R | 70% $CR^{0.15t}$ → 650° C. × 300 sec anneal |
| 25 | S | 70% $CR^{0.15t}$ → 500° C. × 60 sec anneal |
| 26 | T | 70% $CR^{0.15t}$ → 500° C. × 60 sec anneal |
| 27 | P | 72% $CR^{0.15t}$ → 620° C. × 300 sec anneal |

TABLE 4

| Material No. | Steel | 1.0% on-set stress (D-direction, N/mm) | Content of Martensite (%) | Effective grain diameter of Martensite (Å) | Quantity of C-type inclusion, 2.5 μm or more and less than 5.0 μm | Quantity of C-type inclusion, 5.0 μm or more | Quantity of A,B-type inclusion, 2.5 μm or more and less than 3.0 μm | Quantity of A,B-type inclusion, 3.0 μm or more | Workload in punch test (N · mm) | Fracture provability | Rusting area |
|---|---|---|---|---|---|---|---|---|---|---|---|
| 1 | A | 1587 | 52 | 192 | 18 | 0 | 6 | 0 | 1025 | 0 | 0 |
| 2 | A | 1610 | 52 | 192 | 18 | 0 | 6 | 0 | 1029 | 0 | 0 |
| 3 | A | 1704 | 63 | 191 | 0 | 0 | 7 | 0 | 1071 | 0 | 0 |
| 4 | A | 1716 | 63 | 191 | 0 | 0 | 7 | 0 | 1080 | 0 | 0 |
| 5 | A | 2017 | 86 | 194 | 9 | 0 | 6 | 0 | 1104 | 0 | 0 |
| 6 | A | 1709 | 64 | 193 | 4 | 0 | 5 | 0 | 1104 | 0 | 0 |
| 7 | A | 1725 | 64 | 193 | 4 | 0 | 5 | 0 | 1068 | 0 | 0 |
| 8 | B | 1479 | 59 | 194 | 11 | 0 | 4 | 0 | 1506 | 0 | 0 |
| 9 | C | 1883 | 78 | 191 | 5 | 0 | 6 | 0 | 1052 | 0 | 0 |
| 10 | D | 1601 | 47 | 193 | 14 | 0 | 5 | 0 | 1043 | 0 | 0 |
| 11 | E | 1636 | 72 | 191 | 8 | 0 | 8 | 0 | 1057 | 0 | 0 |
| 12 | F | 2058 | 65 | 192 | 7 | 0 | 4 | 0 | 1109 | 0 | 0 |
| 13 | G | 1612 | 52 | 191 | 20 | 0 | 8 | 0 | 1031 | 0 | 0 |
| 14 | H | 1705 | 64 | 192 | 11 | 0 | 12 | 0 | 1079 | 0 | 0 |
| 15 | I | 1708 | 63 | 192 | 16 | 0 | 9 | 0 | 1070 | 0 | 0 |
| 16 | J | 1710 | 64 | 191 | 17 | 0 | 11 | 0 | 1075 | 0 | 0 |
| 17 | K | 1598 | 50 | 193 | 42 | 0 | 25 | 0 | 735 | 20 | 0 |

TABLE 4-continued

| Material No. | Steel | 1.0% on-set stress (D-direction, N/mm) | Content of Martensite (%) | Effective grain diameter of Martensite (Å) | Quantity of C-type inclusion, 2.5 μm or more and less than 5.0 μm | Quantity of C-type inclusion, 5.0 μm or more | Quantity of A,B-type inclusion, 2.5 μm or more and less than 3.0 μm | Quantity of A,B-type inclusion, 3.0 μm or more | Workload in punch test (N · mm) | Fracture provability | Rusting area |
|---|---|---|---|---|---|---|---|---|---|---|---|
| 18 | L | 1711 | 65 | 192 | 47 | 9 | 21 | 9 | 687 | 15 | 0 |
| 19 | M | 1603 | 51 | 195 | 36 | 12 | 46 | 12 | 724 | 25 | 90 |
| 20 | N | 1345 | 51 | 220 | 22 | 0 | 12 | 0 | 692 | 10 | 0 |
| 21 | O | 1252 | 35 | 192 | 27 | 0 | 13 | 0 | 1052 | 30 | 0 |
| 22 | P | unable to measure | 92 | 193 | 13 | 0 | 9 | 0 | 653 | 90 | 0 |
| 23 | Q | 1380 | 62 | 196 | 15 | 0 | 11 | 0 | 1062 | 5 | 0 |
| 24 | R | 1127 | 38 | 194 | 15 | 0 | 11 | 0 | 1073 | 30 | 0 |
| 25 | S | 1589 | 69 | 270 | 37 | 6 | 33 | 6 | 687 | 25 | 0 |
| 26 | T | 1569 | 70 | 266 | 30 | 15 | 24 | 15 | 694 | 20 | 0 |
| 27 | P | 1210 | 45 | 198 | 13 | 0 | 9 | 0 | 1058 | 30 | 0 |

What is claimed is:

1. A high strength and high toughness stainless steel sheet consisting essentially of:

0.01 to 0.2 wt. % C, 0.1 to 2 wt. % Si, 0.1 to 2 wt. % Mn, 4 to 11 wt. % Ni, 13 to 20 wt. % Cr, 0.01 to 0.2 wt. % N, 0.0005 to 0.0025 wt. % sol.Al, 0.002 to 0.01 wt. % O, 0.009 wt. % or less S, and the balance being Fe and inevitable impurities;

said inevitable impurities existing as nonmetallic inclusions, a composition of said nonmetallic inclusions being in a range enclosed with lines connecting nine points in a phase diagram in a 3-component system of "$Al_2O_3$-MnO-$SiO_2$" given below;

Point 1 ($Al_2O_3$: 21%, MnO: 12%, $SiO_2$: 67%),
Point 2 ($Al_2O_3$: 19%, MnO: 21%, $SiO_2$: 60%),
Point 3 ($Al_2O_3$: 15%, MnO: 30%, $SiO_2$: 55%),
Point 4 ($Al_2O_3$: 5%, MnO: 46%, $SiO_2$: 49%),
Point 5 ($Al_2O_3$: 5%, MnO: 68%, $SiO_2$: 27%),
Point 6 ($Al_2O_3$: 20%, MnO: 61%, $SiO_2$: 19%),
Point 7 ($Al_2O_3$: 27.5%, MnO: 50%, $SiO_2$: 22.5%),
Point 8 ($Al_2O_3$: 30%, MnO: 38%, $SiO_2$: 32%),
Point 9 ($Al_2O_3$: 33%, MnO: 27%, $SiO_2$: 40%);

the steel sheet containing 40 to 90% martensite; and the steel sheet having a 1400 N/mm$^2$ or more tensile stress when a tensile strain is 1.0%.

2. The stainless steel sheet of claim 1, wherein the composition of nonmetallic inclusions is in a range enclosed with lines connecting the following 9 points in the phase diagram in a 3-component system of "$Al_2O_3$-MnO-$SiO_2$" given below;

Point 11 ($Al_2O_3$: 20%, MnO: 29.5%, $SiO_2$: 50.5%),
Point 12 ($Al_2O_3$: 12.5%, MnO: 39%, $SiO_2$: 48.5%),
Point 13 ($Al_2O_3$: 12%, MnO: 50%, $SiO_2$: 38%),
Point 14 ($Al_2O_3$: 14%, MnO: 52%, $SiO_2$: 34%),
Point 15 ($Al_2O_3$: 18%, MnO: 52%, $SiO_2$: 30%),
Point 16 ($Al_2O_3$: 24%, MnO: 41%, $SiO_2$: 35%),
Point 17 ($Al_2O_3$: 24.5%, MnO: 33.5%, $SiO_2$: 42%).

3. The stainless steel sheet of claim 1, wherein the steel sheet contains 55 to 65% martensite.

4. A high strength and high toughness stainless steel sheet essentially consisting of;

0.01 to 0.2 wt. % C, 0.1 to 2 wt. % Si, 0.1 to 2 wt. % Mn, 4 to 11 wt. % Ni, 0.08 to 0.9 wt. % Cu, 13 to 20 wt. % Cr, 0.01 to 0.2 wt. % N, 0.0005 to 0.0025 wt. % sol.Al, 0.002 to 0.01 wt. % O, 0.009 wt. % or less S, and the balance being Fe and inevitable impurities;

said inevitable impurities existing as nonmetallic inclusions, a composition of said nonmetallic inclusions being in a range enclosed with lines connecting nine points in a phase diagram in a 3-component system of "$Al_2O_3$-MnO-$SiO_2$" given below;

Point 1 ($Al_2O_3$: 21%, MnO: 12%, $SiO_2$: 67%),
Point 2 ($Al_2O_3$: 19%, MnO: 21%, $SiO_2$: 60%),
Point 3 ($Al_2O_3$: 15%, MnO: 30%, $SiO_2$: 55%),
Point 4 ($Al_2O_3$: 5%, MnO: 46%, $SiO_2$: 49%),
Point 5 ($Al_2O_3$: 5%, MnO: 68%, $SiO_2$: 27%),
Point 6 ($Al_2O_3$: 20%, MnO: 61%, $SiO_2$: 19%),
Point 7 ($Al_2O_3$: 27.5%, MnO: 505, $SiO_2$: 22.5%),
Point 8 ($Al_2O_3$: 30%, MnO: 38%, $SiO_2$: 32%),
Point 9 ($Al_2O_3$: 33%, MnO: 27%, $SiO_2$: 40%);

the steel sheet containing 40 to 90% martensite; and the steel sheet having a 1400 N/mm$^2$ or more tensile stress when a tensile strain is 1.0%.

5. The stainless steel sheet of claim 4, wherein the composition of nonmetallic inclusions is in a range enclosed with lines connecting 7 points in the phase diagram in a 3-component system of "$Al_2O_3$-MnO-$SiO_2$" given below;

Point 11 ($Al_2O_3$: 20%, MnO: 29.5%, $SiO_2$: 50.5%),
Point 12 ($Al_2O_3$: 12.5%, MnO: 39%, $SiO_2$: 48.5%),
Point 13 ($Al_2O_3$: 12%, MnO: 50%, $SiO_2$: 38%),
Point 14 ($Al_2O_3$: 14%, MnO: 52%, $SiO_2$: 34%),
Point 15 ($Al_2O_3$: 18%, MnO: 52%, $SiO_2$: 30%),
Point 16 ($Al_2O_3$: 24%, MnO: 41%, $SiO_2$: 35%),
Point 17 ($Al_2O_3$: 24.5%, MnO: 33.5%, $SiO_2$: 42%).

6. The stainless steel sheet of claim 4, wherein the steel sheet contains 55 to 65% martensite.

7. A method for producing a stainless steel sheet for the comprising the steps of:

preparing a stainless steel strip consisting essentially of 0.01 to 0.2 wt. % C, 0.1 to 2 wt. % Si, 0.1 to 2 wt. % Mn, 4 to 11 wt. % Ni, 13 to 20 wt. % Cr, 0.01 to 0.2 wt. % N, 0.0005 to 0.0025 wt. % sol.Al, 0.002 to 0.01 wt. % O, 0.009 wt. % or less S, and the balance being Fe and inevitable impurities;

said inevitable impurities existing as nonmetallic inclusions, said nonmetallic inclusions being in a range enclosed with the lines connecting nine points in a phase diagram in 3-component system of "$Al_2O_3$-MnO-$SiO_2$" given below;

Point 1 ($Al_2O_3$: 21%, MnO: 12%, $SiO_2$: 67%),
Point 2 ($Al_2O_3$: 19%, MnO: 21%, $SiO_2$: 60%),
Point 3 ($Al_2O_3$: 15%, MnO: 30%, $SiO_2$: 55%),
Point 4 ($Al_2O_3$: 5%, MnO: 46%, $SiO_2$: 49%),
Point 5 ($Al_2O_3$: 5%, MnO: 68%, $SiO_2$: 27%),
Point 6 ($Al_2O_3$: 20%, MnO: 61%, $SiO_2$: 19%),
Point 7 ($Al_2O_3$: 27.5%, MnO: 50%, $SiO_2$22.5%),
Point 8 ($Al_2O_3$: 30%, MnO: 38%, $SiO_2$: 32%),
Point 9 ($Al_2O_3$: 33%, MnO: 27%, $SiO_2$: 40%);

applying to the steel strip a process of first cold rolling ($CR_1$)—first intermediate annealing—second cold rolling ($CR_2$)—second intermediate annealing—third cold rolling ($CR_3$)—the final annealing—fourth cold rolling ($CR_4$)—low temperature heat treatment;

cold reduction ratios of the first-, second- and third cold rolling, each being 30% to 60%;

annealing temperatures in the first-, second- and final annealing being in a range of 950° C. to 1100° C.;

a reduction ratio of the fourth cold rolling being 66% to 76%;

the low temperature heat treatment ranging from 300° C. to 600° C. afor a period 0.1 sec to 300 sec.

8. The method of claim 7, wherein the stainless steel strip consists essentially of 0.01 to 0.2 wt. % C, 0.1 to 2 wt. % Si, 0.1 to 2 wt. % Mn, 4 to 11 wt. % Ni, 0.08 to 0.9 wt. % Cu, 13 to 20 wt. % Cr, 0.01 to 0.2 wt. % N, 0.0005 to 0.0025 wt. % sol.Al, 0.002 to 0.01 wt. % O, 0.009 wt. % or less S, and the balance being Fe and inevitable impurities.

9. The stainless steel sheet of claim 7, wherein the composition of nonmetallic inclusions is a range enclosed with lines connecting 7 points in the phase diagram in a 3-component system of "$Al_2O_3$-MnO-$SiO_2$" given below;

Point 11 ($Al_2O_3$: 20%, MnO: 29.5%, $SiO_2$: 50.5%),
Point 12 ($Al_2O_3$: 12.5%, MnO: 39%, $SiO_2$: 48.5%),
Point 13 ($Al_2O_3$: 12%, MnO: 50%, $SiO_2$: 38%),
Point 14 ($Al_2O_3$: 14%, MnO: 52%, $SiO_2$: 34%),
Point 15 ($Al_2O_3$: 18%, MnO: 52%, $SiO_2$: 30%),
Point 16 ($Al_2O_3$: 24%, MnO: 41%, $SiO_2$: 35%),
Point 17 ($Al_2O_3$: 24.5%, MnO: 33.5%, $SiO_2$: 42%).

10. A high strength and high toughness stainless steel sheet produced by a method comrising the steps of:

preparing a stainless steel strip consisting essentially of 0.01 to 0.2 wt. % C, 0.1 to 2 wt. % Si, 0.1 to 2 wt. % Mn, 4 to 11 wt. % Ni, 13 to 20 wt. % Cr, 0.01 to 0.2 wt. % N, 0.0005 to 0.0025 wt. % sol.Al, 0.002 to 0.01 wt. % O, 0.009 wt. % or less S, and the balance being Fe and inevitable impurities;

said inevitable impurities existing as nonmetallic inclusions, said nonmetallic inclusions being in a range enclosed with the lines connecting nine points in the phase diagram in 3-component system of "$Al_2O_3$-MnO-$SiO_2$" given below;

Point 1 ($Al_2O_3$: 21%, MnO: 12%, $SiO_2$: 67%),
Point 2 ($Al_2O_3$: 19%, MnO: 21%, $SiO_2$: 60%),
Point 3 ($Al_2O_3$: 15%, MnO: 30%, $SiO_2$: 55%),
Point 4 ($Al_2O_3$: 5%, MnO: 46%, $SiO_2$: 49%),
Point 5 ($Al_2O_3$: 5%, MnO: 68%, $SiO_2$: 27%),
Point 6 ($Al_2O_3$: 20%, MnO: 61%, $SiO_2$: 19%),
Point 3 ($Al_2O_3$: 27.5%, MnO: 50%, $SiO_2$: 22.5%),
Point 8 ($Al_2O_3$: 30%, MnO: 38%, $SiO_2$: 32%),
Point 9 ($Al_2O_3$: 33%, MnO: 27%, $SiO_2$: 40%);

applying to the stainless strip a process of first cold rolling ($CR_1$)—first intermediate annealing—second cold rolling ($CR_2$)—second intermediate annealing—third cold rolling ($CR_3$)—final annealing—fourth cold rolling ($CR_4$)—low temperature heat treatment;

cold reduction ratios of the first-, second- and third cold rolling, each being 30% to 60%;

annealing temperatures in the first-, second- and last annealing being in a range of 950° C. to 1100° C.;

a cold reduction ratio of the fourth cold rolling being 66% to 76%;

the low temperature heat treatment ranging from 300° C. to 600° C. for a period 0.1 sec to 300 sec.

11. The stainless steel sheet of claim 10, wherein the stainless steel strip consists essentially of 0.01 to 0.2 wt. % C, 0.1 to 2 wt. % Si, 0.1 to 2 wt. % Mn, 4 to 11 wt. % Ni, 0.08 to 0.9 wt. % Cu, 13 to 20 wt. % Cr, 0.01 to 0.2 wt. % N, 0.0005 to 0.0025 wt. % sol.Al, 0.002 to 0.01 wt. % O, 0.009 wt. % or less S, and the balance being Fe and inevitable impurities.

12. The stainless steel sheet of claim 10, wherein the composition of nonmetallic inclusions is in a range enclosed with lines connecting 7 points in the phase diagram in a 3-component system of "$Al_2O_3$-MnO-$SiO_2$" given below;

Point 11 ($Al_2O_3$: 20%, MnO: 29.5%, $SiO_2$: 50.5%),
Point 12 ($Al_2O_3$: 12.5%, MnO: 39%, $SiO_2$: 48.5%),
Point 13 ($Al_2O_3$: 12%, MnO: 50%, $SiO_2$: 38%),
Point 14 ($Al_2O_3$: 14%, MnO: 52%, $SiO_2$: 34%),
Point 15 ($Al_2O_3$: 18%, MnO: 52%, $SiO_2$: 30%),
Point 16 ($Al_2O_3$: 24%, MnO: 41%, $SiO_2$: 35%),
Point 17 ($Al_2O_3$: 24.5%, MnO: 33.5%, $SiO_2$: 42%).

13. The stainless steel sheet of claim 10, said steel sheet is a steel sheet for an inner diameter saw blade.

14. The stainless steel sheet of claim 10, said steel sheet is a stainless steel sheet for spring.

* * * * *